US005184487A

United States Patent [19]

Corner

[11] Patent Number: 5,184,487

[45] Date of Patent: Feb. 9, 1993

[54] MACHINE FOR SOFTENING AND STRETCHING LAMINAR PRODUCTS, PARTICULARLY TANNED HIDES

[75] Inventor: Antonio Corner, Thiene, Italy

[73] Assignee: Officine di Cartigliano S.p.A., Italy

[21] Appl. No.: 595,306

[22] Filed: Oct. 10, 1990

[30] Foreign Application Priority Data

Oct. 13, 1989 [IT] Italy ..... 85662 A/89

[51] Int. Cl.[5] ..... C14B 1/26

[52] U.S. Cl. ..... 69/19.1

[58] Field of Search ..... 69/1.5, 19, 19.1, 19.2, 69/19.3, 21, 33, 46; 100/214, 222, 295

[56] References Cited

U.S. PATENT DOCUMENTS

| | | | |
|---|---|---|---|
| 2,956,427 | 10/1960 | Blatz et al. | 69/33 |
| 3,398,557 | 8/1968 | Dokoupil et al. | 69/33 |
| 3,677,041 | 7/1972 | Dokoupil | 69/33 |
| 4,051,700 | 10/1977 | Dokoupil | 69/33 |
| 4,100,771 | 7/1978 | Dokoupil | 69/33 |
| 4,559,793 | 12/1985 | Geweniger | 69/33 |

FOREIGN PATENT DOCUMENTS

| | | | |
|---|---|---|---|
| 169639 | 9/1975 | Czechoslovakia . | |
| 288264 | 10/1988 | European Pat. Off. | 69/19.1 |
| 368233 | 5/1990 | European Pat. Off. | 69/19.1 |
| 1285092 | 5/1963 | Fed. Rep. of Germany . | |
| 883012 | 12/1970 | Italy | 69/19.1 |
| 299546 | 6/1977 | U.S.S.R. . | |

*Primary Examiner*—Andrew M. Falik
*Assistant Examiner*—Michael A. Neas
*Attorney, Agent, or Firm*—Wolf, Greenfield & Sacks

[57] ABSTRACT

A method for softening and stretching tanned hides, in a substantially manner, by applying on both sides of the hides opposite and reciprocating forces with a predetermined stroke which are substantially perpendicular to the surfaces of the hides, such forces being applied, on one side of the hides, by means of rigid elements acting on mutually spaced portions of the work area and, on the other side, by means of an elastically yielding planar uniform support acting on the entire work area. The rigid elements have active dome shaped portions with a radius of curvature which is greater than the stroke of application of the opposite forces.

12 Claims, 2 Drawing Sheets

MACHINE FOR SOFTENING AND STRETCHING LAMINAR PRODUCTS, PARTICULARLY TANNED HIDES

BACKGROUND OF THE INVENTION

The present invention relates to a method and to a machine for softening and stretching laminar products, particularly tanned industrial hides, in a substantially continuous manner. In this specific field, the process according to the invention is commonly termed perching and the machine for performing it is termed percher or perching knife.

Perching is performed on the hides after the tanning and partial drying treatments, after which the fibers are entangled and shortened, making the hides rigid and hard. By means of perching, the fibers are stretched, separated and aligned so as to provide the hides with their original elasticity and softness.

Heretofore, perching was performed by manually stretching the hides and rubbing them vigorously against typical knifeshaped tools. In modern automatic machines, studied to reduce or eliminate physical effort and make the treatment faster, the old manual tools have been replaced with levers, rollers or, more recently, with oscillating plates. These more recent machines offer the advantages of making the treatment continuous, considerably increasing the productivity of the treatment itself.

All the automatic machines mentioned above use a method which consists in applying, on the opposite sides of the hides, opposite forces which are substantially perpendicular to their surfaces. Said forces are applied in mutually spaced regions on one side of the hides and in intermediate regions between said spaced regions on the other side, so as to exert, between the working regions, traction forces exceeding the elasticity limit of the fibers, with consequent multi-directional elongations.

The Italian paten IT-A-883912 discloses a perching machine applying the above described method, comprising a pair of facing plates between which the hides to be treated are caused to advance; at least one of the plates moves with a reciprocating motion closer and further away from the other plate to engage the interposed hides. On at least one of the facing plates there is provided a series of mutually equispaced protruding elements which are substantially formed by pins or dowels with a rounded end which are adapted to cooperate with a series of opposite elements provided on the other plate. In this known machine, the elements of the second plate consist of cavities which are complementarily shaped with respect to the protruding elements. In an alternate embodiment, the elements of the second plate may consist of a second series of protruding elements which are arranged in the free spaces between the first elements. The elements of the plates are not directly acting on the hides to be treated, but by means of a pair of adjacent elastic belts which, by virtue of their concurrent movement, cause the advancement of the hides in a direction which is perpendicular to the movement of the plates.

Machines of this type allow considerable productivity, mainly in view of the high frequency of the transverse oscillating motion of the plates, which is generally comprised between 5 and 10 strokes per second and is coordinated with the longitudinal advancement movement of the belts. However, these machines have some known problems. In order that the machine be adapted to the different thickness and texture of the hides, the minimum distance between the plates is accordingly varied so that a variation in the degree of penetration of the opposite elements and therefore of the obtained stretching corresponds to this distance variation. It is evidently a main object to increase as much as possible the elongation of the fibers to widen the footage of the hides. Unfortunately, an excessive degree of penetration can cause indelible markings and even breakage of the hides and/or of the belts at the coupling locations of the elements.

In order to improve the degree of uniformity of the stretching for an equal degree of penetration of the plates, it is furthermore necessary to reduce the advancement speed of the belts so as to expose a same region to a repeated treatment, with the consequence, however, of reducing the machine's productivity.

Another disadvantage which is frequently observed in said known machines is the so-called boundary effect, i.e. the lack of stretching along the peripheral region of the plates. Whereas in the central regions of the plates the hides are stably locked by the active surfaces of the adjacent elements, proximate to the edges this locking action is in fact partially missing and is reducing the stretching action. A system for reducing this disadvantage consists in moving the plates closer, increasing the degree of penetration of the active elements on the entire work area so as to increase the locking forces proximate to the edges as well. However, this solution can cause such an increase in the stretching of the hides toward the center of the plates so as to cause unrecoverable damage due to the above mentioned reasons.

SUMMARY OF THE INVENTION

The aim of the present invention is to obviate the disadvantages described above by providing a perching method as well as a perching machine which can achieve a considerable stretching of the hides in a reliable and safe manner.

Within the scope of the above described aim, a particular object of the invention is to provide a perching method and machine suitable for exerting on the hides a substantially uniform stretching on large regions without concentrating localized stresses, so as to optimize softening of the hides.

A further object of the invention is to provide a perching machine which is constructively extremely simple so as to require reduced maintenance and modest production costs.

Not least object of the present invention is to provide a perching machine which can be obtained starting from commonly commercially available elements and materials so as to be advantageous from a merely commercial point of view.

This aim, these objects and others which will become apparent hereinafter are achieved by a method and a machine for stretching and softening laminar products having a plurality of stretching plates in which one of the plates is provided with rigid protruding elements while the other is covered with an elastic layer, so that the leather is uniformly and elastically supported permitting substantially uniform stretching action with no concentration of stress or elongation of the fibers.

BRIEF DESCRIPTION OF THE DRAWINGS

Further characteristics and advantages of the invention will become apparent from the description of a preferred but not exclusive embodiment of the method and of the machine according to the invention, which are illustrated only by way of non-limitative example in the accompanying drawings, wherein.

DESCRIPTION OF THE PREFERRED EMBODIMENTS

Figure 1:
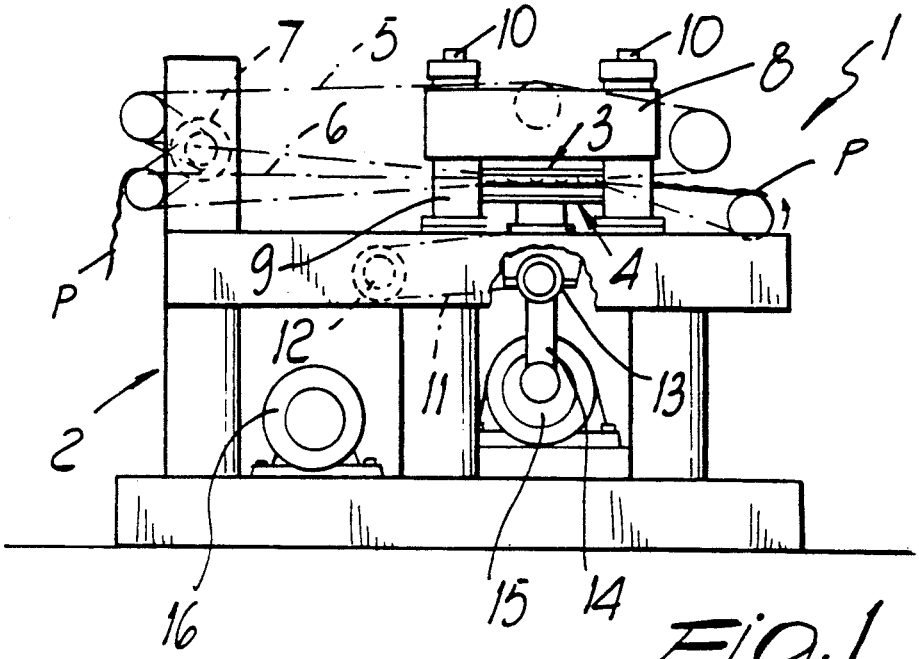
FIG. 1 is a schematic side view of a machine according to the invention.
Figure 2:
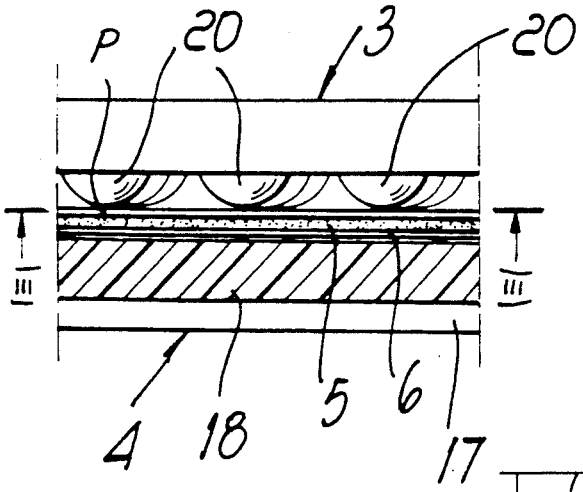
FIG. 2 is an enlarged detail view of FIG. 1.
Figure 3:
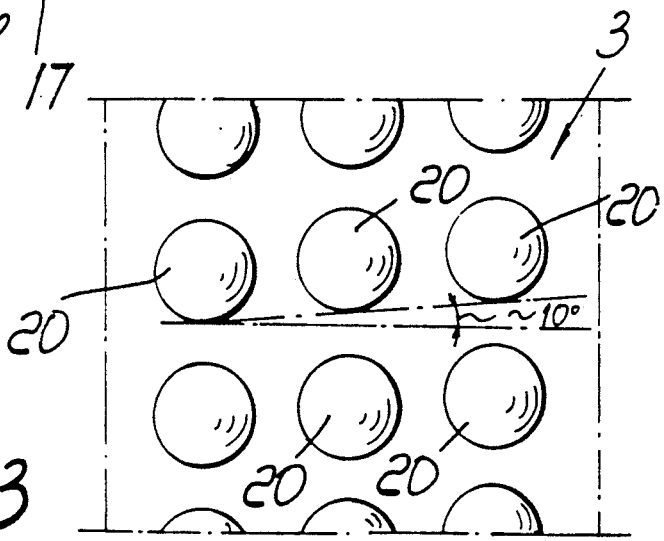
FIG. 3 is a sectional view of the detail of FIG. 2 taken along the line III—III.
Figure 4:
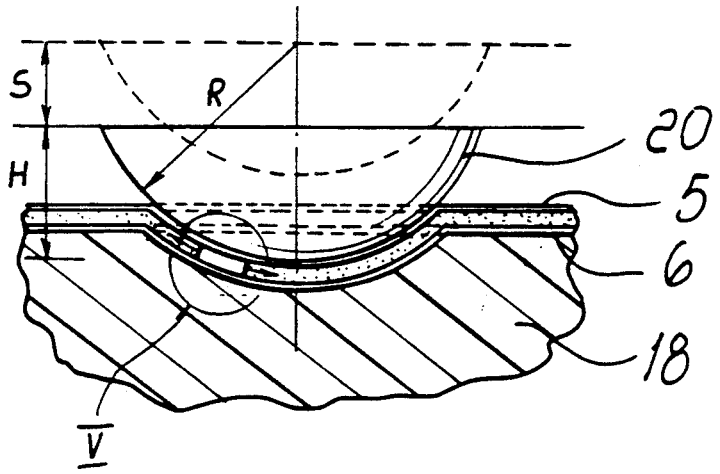
FIG. 4 is a further enlarged view of the elements of FIG. 2 in the step of interaction with an interposed hide.

With reference to the above figures, the machine according to the invention, generally indicated by the reference numeral 1, comprises a supporting frame 2 which can be fixed to the ground and supports and upper plate 3 and a lower plate 4 which are arranged on opposite sides with respect to the hides P to be treated.

The hides are caused to advance longitudinally by means of a pair of conveyor belts 5, 6 made of flexible material which concordantly extend in the direction indicated by the arrows F by means of a variable-speed motor 7. The conveyor belts 5, 6 may consist of loops of laminated plastic or natural or synthetic fabric coated with a layer of synthetic material.

The upper plate 3 is rigidly associated with the supporting frame of the machine by means of a plate 8 which is fixed on at least one pair of columns 9 by means of fine adjustment screws 10. The lower plate is fixed to a structure 11 which is illustrated in broken lines in FIG. 1 and is pivoted to the supporting frame 2 by means of a first end support 12 and to a connecting rod 14 by means of a second end support 13. Said connecting rod 14 is in turn pivoted to an eccentric element 15 which is driven by a motor 16. From such an arrangement it is evident that the rotation of the motor 16 causes the alternated approach and spacing of the lower plate 4 with respect to the upper plate 3. In order to adjust the minimum distance of the plates so as to vary the intensity of the stretching and adapt the machine to the thickness and texture of the hides, it is possible to vary the height of the plate 8 by appropriately rotating the fine adjustment screws 10.

Advantageously, the lower plate 4 is formed by a substantially planar containment support 17 which is covered by a layer 18 of an elastically yielding material. The materials which can be used for this layer can be constituted by isoelastic elastomers with extremely low mechanical hysteresis but with a certain rigidity so as to transmit transverse forces of considerable intensity, with a hardness comprised between 10 and 50 shores, such as elastomers like neoprene, natural rubbers, nitrile or butyl rubbers and synthetic rubbers in general.

The thickness of the layer 18 is at least equal to the stroke S of the plates to allow the complete penetration of the facing plate.

Conveniently, according to the invention, the upper plate 3 has a series of protruding elements 20 which have the shape of a spherical dome with radius R and height H. The radius R can be comprised between 15 mm and 30 mm and is preferably equal to approximately 20 mm. The height H can be comprised between 50% and 80% and is preferably equal to 70% of the radius R.

The spherical dome-like shape offers a relatively large contact surface, and by means of experimental tests it has shown that it optimally transmits the stretching forces with a relatively short stroke.

The protruding elements 20, made of steel with high resistance to mechanical stresses and to wear, are arranged of the plate 3 with a checkerboard distribution of a per se known type, along transverse rows which are substantially perpendicular to the direction of advancement of the hides and along longitudinal columns which are inclined by approximately 10° with respect to the direction of advancement of the hides. By virtue of this arrangement, the hides encounter, during their advancement, rows of elements which are progressively laterally offset so as to affect, after a certain longitudinal movement, the entire width of the hides.

Figure 5:
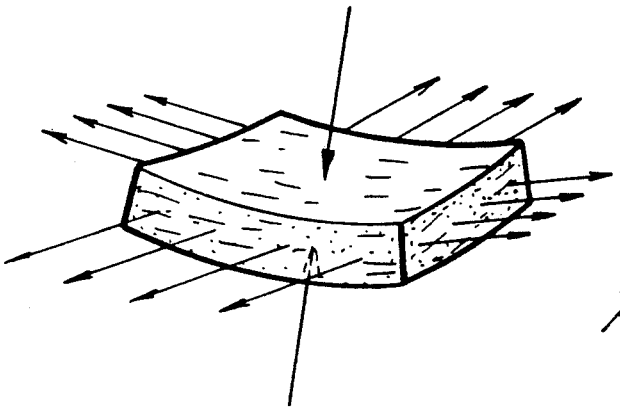
FIG. 5 is a schematic view of a spatial diagram of the forces which act in an infinitesimal portion of hide subjected to the method according to the invention.
Figure 6:
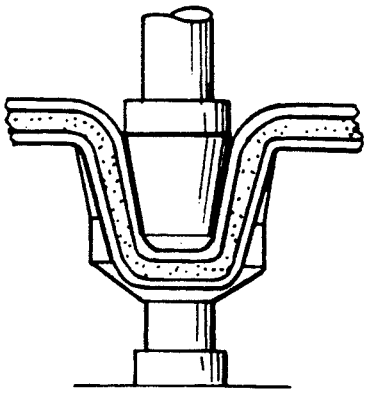
FIG. 6 is a schematic view of the different state of tension of the hides obtained by a machine according to the known art which is prior to the one obtained with the machine according to the present invention.

The final result which can be observed on the hides is represented by a substantially uniform distribution of the tensions, as schematically represented in FIG. 5, such as to significantly reduce the risk of damage and breakage typical of the prior art. Said damage and breakage were in fact mainly due to the considerable concentrations of stresses at the small radii of curvature and at the tension gradients at the top of the pins, as schematically illustrated in FIG. 6.

By virtue of the lower specific pressures exerted by the elements 20 on the hides it is possible to use higher oscillation frequencies as well as higher penetration degrees and feeding speeds than those of the prior art, with correspondingly improved productivity and better final quality of the process.

The greater degree of stretching which can be obtained by means of this machine in extremely safe conditions furthermore allows to achieve a significant increase in the final footage which is equal to approximately 2-3% of the total surface.

Finally, the large engagement surfaces of the spherical dome shaped elements exert adequate locking forces even in the peripheral regions of the plates, reducing the so-called boundary effect.

In practice it has been observed that the method and the machine according to the invention fully achieve the intended aim, since they allow to optimize softening and stretching of the hides with no risks of damage or breakage thereof.

The machine thus conceived is susceptible to numerous modifications and variations, all of which are within the scope of the inventive concept defined in the accompanying claims. All the details may furthermore be replaced with technically equivalent elements. For example, the spherical dome-like shape of the protruding elements can be replaced with ellipsoidal or hemispherical shapes possibly associated with an essentially cylindrical base which forms a tang for coupling to the plate. The kinematic arrangement of the elements can furthermore be inverted by moving the plate provided with protruding elements and fixing the plate covered by the elastically yielding layer without falling outside of the inventive scope concept.

I claim:

1. A machine for continuously softening and stretching flexible laminar products having opposite side surfaces, said machine comprising a frame supporting at least one pair of facing plates arranged on opposite sides of the flexible laminar products under treatment, one of said plates being stationary with respect to the frame, the other said plate being movable in a direction substantially perpendicular with respect to the one said plate and to side surfaces of the products, means for oscillating said movable plate with a predetermined frequency between a first position at a minimum distance from said stationary plate and a second position at a maximum distance from said stationary plate, a pair of flexible conveyor belts arranged between said plates to contact and engage the opposite sides of the products to cause advancement thereof in a direction substantially parallel to said plates, wherein one of said plates is a substantially rigid planar support which is covered with a substantially uniform layer of elastically yielding material having no interruption and no rigid projection, the other plate being provided with a plurality of substantially rigid protruding elements adapted to interact with said uniform layer of the one said plate, said uniform layer having a thickness at least equal to the distance between said first and second positions so as to permit full penetration of said protruding elements to a certain depth of penetration, said protruding elements having a substantially curved shape with a radius of curvature greater than said depth of penetration, so that the products under treatment are subject to a substantially uniform stretching action with no concentration of stress, thus reducing the risk of marking and permitting safe increases in depth of penetration and frequency of oscillation of said plates.

2. Machine according to claim 1, wherein the radius of curvature of said protruding elements is between about 15 and 20 mm.

3. Machine according to claim 1, wherein said depth of penetration is between about 50% and 80% of said radius of curvature.

4. Machine according to claim 1, wherein said protruding elements are arranged on the surface of one of the plates along a plurality of rows which are substantially equispaced and extend perpendicularly to the direction of said belts.

5. Machine according to claim 1, wherein said protruding elements are arranged along a plurality of longitudinal columns which are inclined by approximately 10° with respect to the direction of said belts.

6. Machine according to claim 1, wherein said elastically yielding uniform layer is made of isoelastic elastomeric material with a hardness between about 10 and 50 Shores.

7. Machine according to claim 6, wherein said elastically yielding uniform layer is made of isoelastic elastomeric material with a hardness between about 10 and 50 shores, said elastomeric material selected from the group consisting of neoprene, natural rubbers and synthetic rubbers.

8. A machine according to claim 1, wherein said flexible belts comprise a laminate, said laminate selected from the group consisting of laminated plastic, natural fabric coated with a layer of synthetic material, and synthetic fabric coated with a layer of synthetic material.

9. A machine according to claim 2, wherein the radius of curvature of said protruding elements is equal to about 20 mm.

10. A machine according to claim 3, wherein the distance between said first and second positions is about 70% of said radius of curvature.

11. A machine of claim 1, wherein said flexible laminar products are selected from the group consisting of leather and tanned hides.

12. A machine of claim 1, wherein said protruding elements comprise a shape selected from the group consisting of spheroidal, ellipsoidal, and hemispheroidal shapes.

* * * * *